US007150544B2

(12) United States Patent
Pearce et al.

(10) Patent No.: US 7,150,544 B2
(45) Date of Patent: Dec. 19, 2006

(54) LEVELER FOR LIGHT ASSEMBLY

(75) Inventors: Richard A. Pearce, Byhalia, MS (US); Richard Orion Millaway, Memphis, TN (US)

(73) Assignee: Hunter Fan Company, Memphis, TN (US)

( * ) Notice: Subject to any disclaimer, the term of this patent is extended or adjusted under 35 U.S.C. 154(b) by 242 days.

(21) Appl. No.: 10/979,573

(22) Filed: Nov. 2, 2004

(65) Prior Publication Data

US 2006/0092628 A1 May 4, 2006

(51) Int. Cl.
*F21S 8/06* (2006.01)
*F21V 29/00* (2006.01)

(52) U.S. Cl. ..... 362/404; 362/149; 362/373; 362/408; 248/342

(58) Field of Classification Search ..... 362/147, 362/149, 294, 373, 404, 408, 96, 454; 416/5; 248/342, 343, 344
See application file for complete search history.

(56) References Cited

U.S. PATENT DOCUMENTS 4,342,073 A * 7/1982 Ranten ..... 362/294
4,634,345 A * 1/1987 Stanek et al. ..... 416/244 R
6,089,725 A * 7/2000 Chen ..... 362/96
6,234,757 B1 * 5/2001 Pearce ..... 416/244 R
6,296,377 B1 10/2001 Wilson et al. ..... 362/370
6,322,232 B1 11/2001 Oliver ..... 362/147
6,494,589 B1 * 12/2002 Shyu ..... 362/96

* cited by examiner

*Primary Examiner*—Stephen Husar
*Assistant Examiner*—Peggy A. Neils
(74) *Attorney, Agent, or Firm*—Baker Donelson

(57) ABSTRACT

A light assembly leveler (10) is disclosed having a threaded central nipple (13) mounted to the ceiling fan switch housing (11), an upper mounting disk (14), a lower mounting disk (15), a bowl-shaped translucent light diffusor (16), a cap (18) and a finial (19). The upper mounting disk (14) has a central passage (23) through which the nipple (13) extends and a concave bottom bearing surface (24). The lower mounting disk has a convex top bearing surface (28) with a central opening (29) therethrough defined. The top bearing surface is configured to mate with or bear against the bottom bearing surface of the upper mounting disk to allow rotary movement of the lower mounting disk relative to the upper mounting disk. The cap has an upper peripheral rim (34) and a centralized concave lower bearing surface (35) with a central opening (36) therethrough. The cap is configured to abut the diffusor. A finial (38) is threaded onto the lower end of the nipple. The finial has a top bearing surface (40) configured to mate with the lower bearing surface of the cap to allow rotary movement of the cap relative to the finial.

16 Claims, 3 Drawing Sheets

LEVELER FOR LIGHT ASSEMBLY

TECHNICAL FIELD

This invention relates generally to light assemblies, and more particularly to light assemblies having a leveling device which may be used in conjunction with a ceiling fan.

BACKGROUND OF THE INVENTION

Ceiling fans having a number of motorized rotating blades have existed for many years. Many of today's ceiling fans include a light assembly or light kit which may be used in the place of a light fixture mounted to the ceiling. These light assemblies typically are mounted to the bottom of the ceiling fan below the plane of rotation of the fan blades.

These light assemblies typically include a nipple extending from the bottom of the ceiling fan motor housing, a glass bowl or multi-arm light distributor positioned upon the nipple, and a finial threaded onto the end of the nipple to hold the glass bowl in place, as shown in U.S. Pat. No. 6,322,232. This construction is also used in other types of light fixtures, such as those shown in U.S. Pat. No. 6,296,377. A common problem which exists with these light assemblies relates to the leveling of the glass bowl or light distributor, referred to hereinafter collectively as a light diffusor. Oftentimes, the diffusor is crooked with respect to the ceiling fan, wall or ceiling to which it is mounted. As such, the installer must bend the nipple to adjust for the misalignment. This method of correction is inaccurate and may lead to damaging the nipple or light fixture, and as such is not recommended.

Accordingly, it is seen that a need remains for a light assembly which may be adjusted to level the diffusor. It is to the provision of such therefore that the present invention is primarily directed.

SUMMARY OF THE INVENTION

In a preferred form of the invention a light assembly with leveler comprises a first mounting member having a concave bearing surface, a mounting rod extending from the first mounting member, a second mounting member having a convex bearing surface and a concave lower bearing surface opposite the convex bearing surface. The convex bearing surface is configured to mate with the first mounting member concave bearing surface and has an opening therethrough. The leveler also has a fastener coupled to the mounting rod, the fastener having a convex bearing surface configured to mate with the second mounting member concave bearing surface, and a light diffusor coupled to the second mounting member. With this construction, the second mounting member is movable relative to the first mounting member.

DETAILED DESCRIPTION

Figure 1:
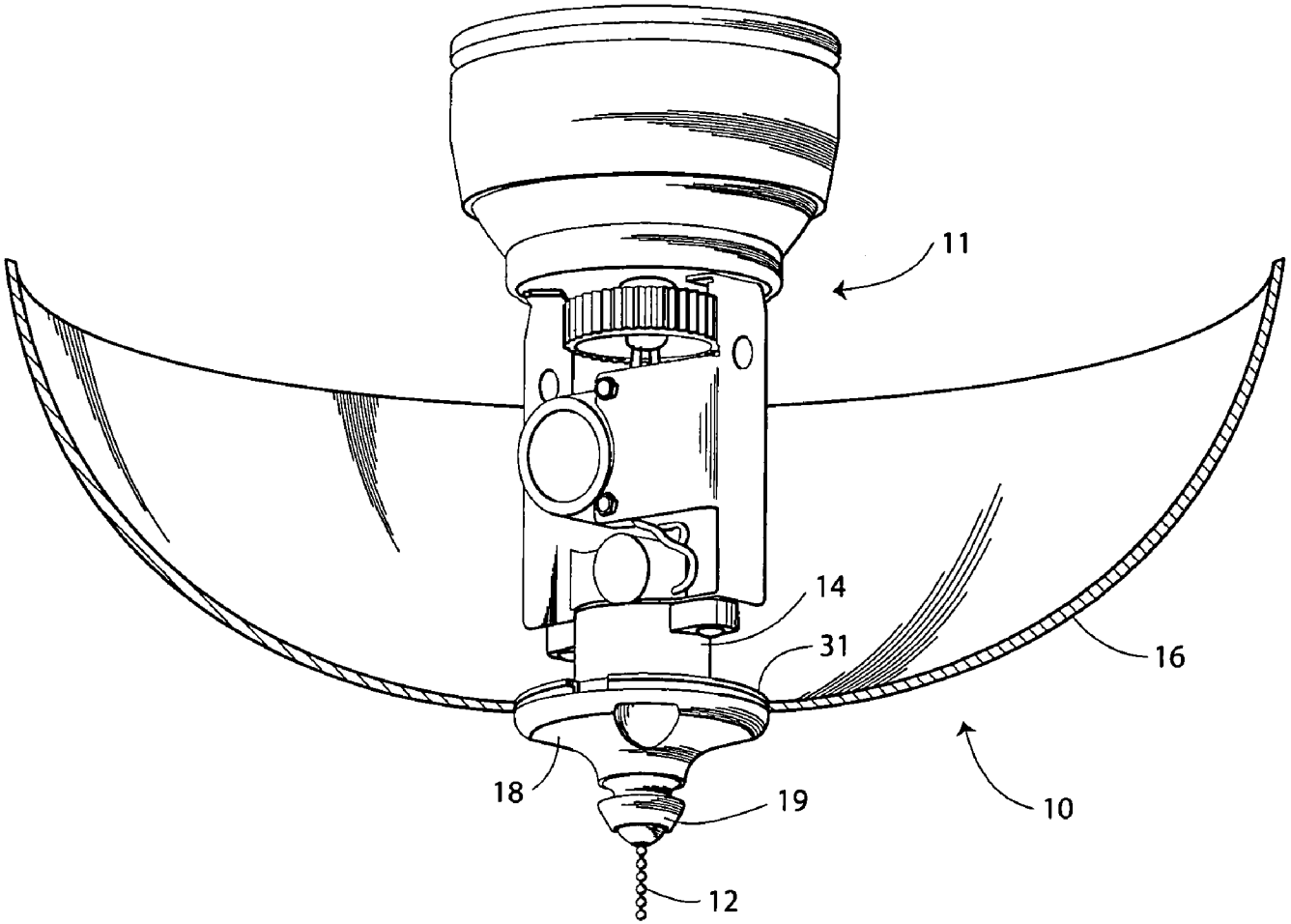
FIG. 1 is a perspective view of a light assembly embodying principles of the invention in a preferred form, shown in the form of a ceiling fan light assembly.

With reference next to the drawings, there is shown a light assembly leveler 10 in a preferred form of the invention which is adapted to be coupled to a ceiling fan. The ceiling fan is of common construction as shown in U.S. Pat. No. 6,322,232 which is specifically incorporated herein by reference. The light assembly 10 is positioned below the motor and blade irons and is mounted to the bottom of the switch housing 11. In order to control the speed of rotation of the fan blades the motor has a control switch which can be controlled conventionally through actuation of a pull chain or string 12 or remote controlled electrical controller.

The light assembly leveler 10 includes a threaded central nipple or mounting rod 13 mounted to the ceiling fan switch housing 11, an upper mounting disk or member 14, a lower mounting disk or member 15, a bowl-shaped translucent light diffusor 16 coupled to the lower mounting disk 15, a cap 18 and a finial, stop or fastener 19.

The upper mounting disk 14 has two mounting holes 21 through which two mounting screws 22 are passed and threaded into the bottom of the switch housing 11 to secure the upper mounting disk 14 to the switch housing 11. The upper mounting disk 14 also has a central passage 23 through which the nipple 13 extends and a concave bottom bearing surface 24. The concave bottom bearing surface 24 terminates at a central mounting flange 25 extending concentrically about the nipple 13.

The lower mounting disk 15 has a convex top bearing surface 28 with a central opening 29 therethrough defined by a downwardly extending central flange 30. The top bearing surface 28 is configured to mate with or bear against the bottom bearing surface 24 of the upper mounting disk 14 to allow rotary movement of the lower mounting disk 15 relative to the upper mounting disk 14, i.e., the top bearing surface conforms with the bottom bearing surface. The central flange 30 extends concentrically about the nipple 13. The lower mounting disk 15 also has a peripheral flange 31 configured to mate with the diffusor 16.

The cap 18 has an upper peripheral rim 34 and a centralized concave lower bearing surface 35 with a central opening 36 therethrough. The cap is configured to abut the diffusor 16.

Finally, a finial 38 is threaded onto the lower end of the nipple 13 through an internally threaded central passage 39. The finial 38 has a top bearing surface 40 configured to mate with the lower bearing surface 35 of the cap 18 to allow rotary movement of the cap 18 relative to the finial 38. The pull chain 12 extends through the nipple 13 and the finial central passage 39 and emerges from the bottom of the finial for operational access by a person.

In use, with the upper mounting disk 14 and nipple 13 mounted to the switch housing 11 the combination diffusor 16 and lower mounting disk 15 is positioned about the nipple 13 and raised until the lower mounting disk 15 abuts the upper mounting disk 14. Next, the cap 18 is positioned upon the nipple 13 and the finial 38 is threaded onto the bottom end of the nipple. It should be understood that the lower mounting disk 15 and cap 18 may be unitary or fixed to each as an alternative. The finial 38 is threaded onto the nipple 13 to a position wherein it abuts the lower bearing surface 35 of the cap, yet still allows movement of the cap relative to the finial and movement of the lower mounting disk relative to the upper mounting disk.

An installer may now maneuver or manipulate the diffusor to a level position by simply grasping the diffusor and manually moving it in the desired direction. The mating engagement of the upper mounting disk bottom bearing surface 24 with the lower mounting disk top bearing surface 28 and the mating engagement of the cap lower bearing surface 35 and the finial top bearing surface 40 allows rotational movement of the diffusor 16 relative to the ceiling fan and its switch housing 11.

Once the diffusor 16 is placed in the desired, level position the finial 38 is further threaded onto the nipple 13 to lock the relative position of the diffusor.

It should be understood that the lower mounting disk central opening 29 allows the lower mounting disk to be moved or rotated relative to the stationary nipple. However, this relative movement is limited by the abutment of the lower mounting disk central flange 30 with the upper mounting disk mounting flange 25. This abutment prevents the central flange 30 from hitting and thereby damaging the nipple 13 during movement of the diffusor.

Figure 2:
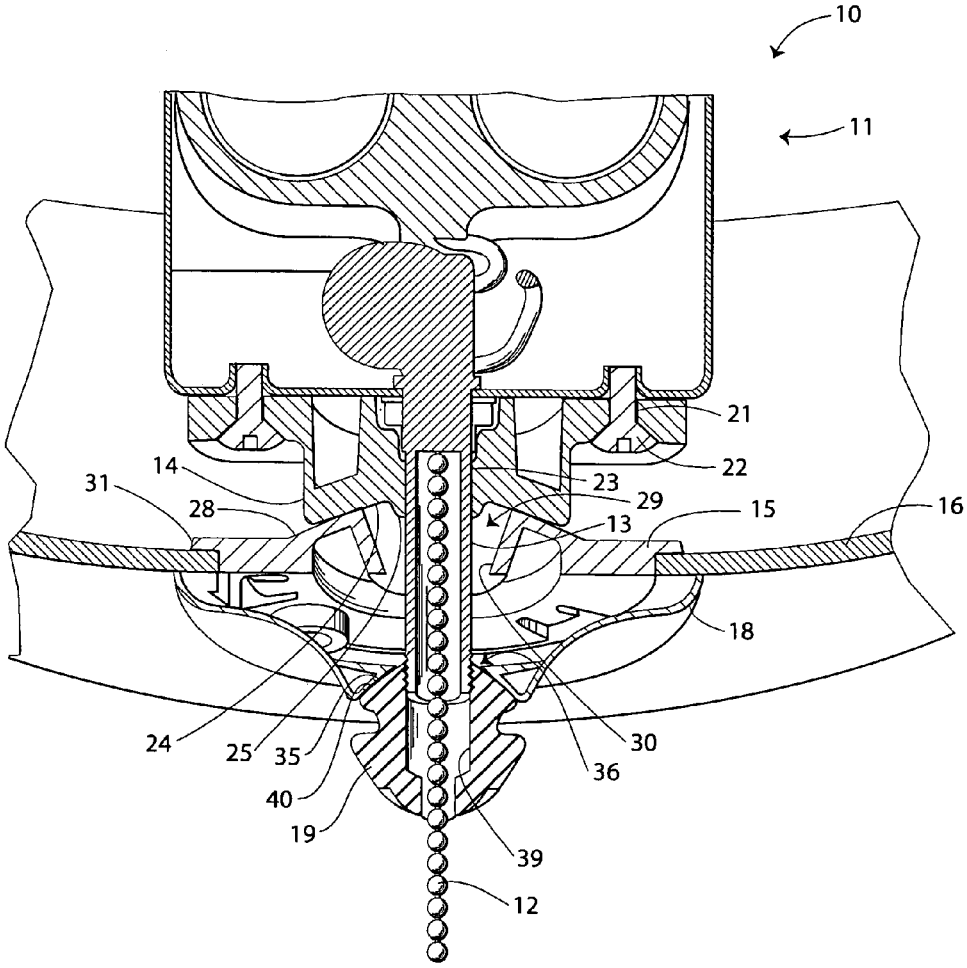
FIG. 2 is a side view, in partial cross-section, of the light assembly of FIG. 1.
Figure 3:
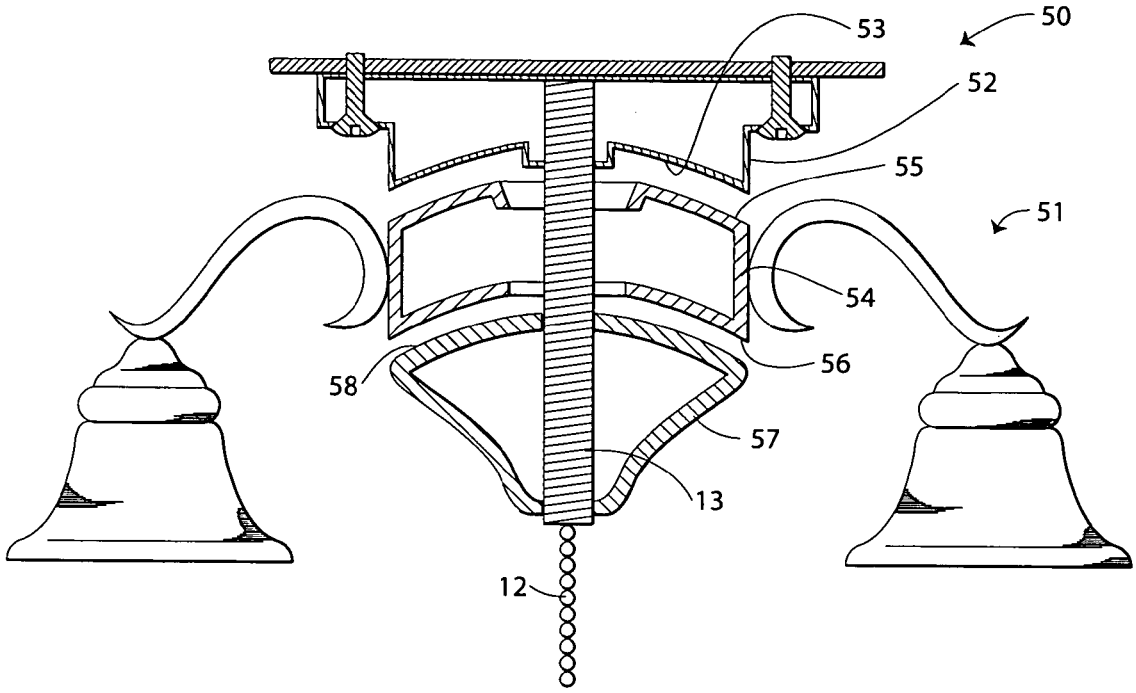
FIG. 3 is a side view, in partial cross-section, of a light assembly in another preferred form.

With reference next to FIG. 3, there is shown a leveler in another preferred form of the invention. The leveler is essentially the same as that recited in reference to FIGS. 1 and 2 except for the diffusor. Here, the diffusor is configured as a conventional multi-armed light assembly 51. The light assembly 51 includes an upper mounting disk 52 with a concave bottom bearing surface 53, a lower mounting disk 54 with a convex top bearing surface 55 and a concave lower bearing surface 56, and a finial 57 with a top bearing surface 58. The nipple 13 extends from the upper mounting disk 52, through the lower mounting disk 54, and is threaded into the finial 57. Rotational movement of the lower mounting disk 54 through the two oppositely disposed, concentric bearing surfaces enables the multi-armed diffusor to be manually moved to a level position and then locked as previously described.

Figure 4:
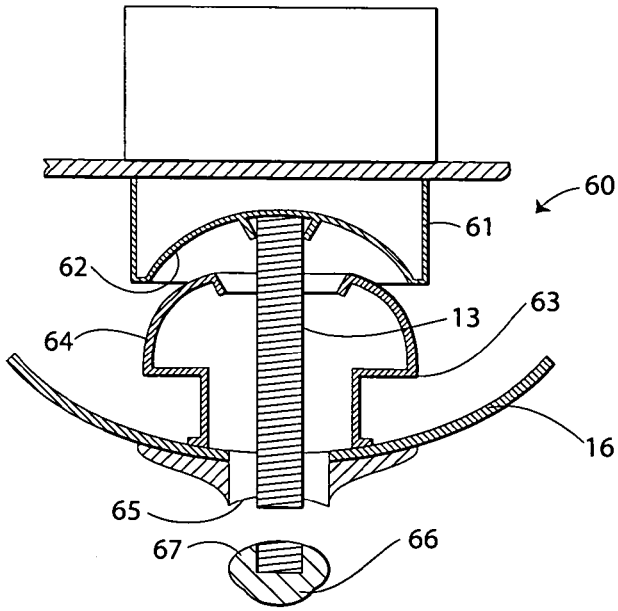
FIG. 4 is a side view, in partial cross-section, of a light assembly in yet another preferred form.

With reference next to FIG. 4, there is shown a leveler 60 in another preferred form of the invention. The leveler 60 is essentially the same as that recited in reference to FIGS. 1, 2 and 3 except for that the light assembly is coupled to a wall or ceiling rather than a ceiling fan. Here, the light assembly may be of any conventional configuration or appearance but it includes the leveler feature of the present invention. The light assembly includes an upper mounting disk 61 with a concave bottom bearing surface 62, a lower mounting disk 63 with a convex top bearing surface 64 and a concave lower bearing surface 65, and a finial 66 with a top bearing surface 67. The nipple 13 extends from the upper mounting disk 61, through the lower mounting disk 63, and is threaded into the finial 66. The upper mounting disk 61 is mounted to a conventionally known light mounting plate or mounting box or alternatively to the bottom of a light assembly. It should be understood that the actual lighting components are not shown for clarity of explanation. Again, rotational movement of the lower mounting disk 63 enables the diffusor to be manually moved to a level position and then locked as previously described.

It should be understood that the present invention may be used with any light assembly whether it be a ceiling fan bowl-shaped diffusor, a ceiling fan multi-armed assembly, a ceiling light, or a wall light such as a sconce. It should also be understood that throughout all the embodiments shown herein the lower mounting disk 15 and cap may be unitary, fixed to each other, or fixed to the diffusor as an alternatives. Hence, the cap may be referred to as a part of the lower mounting disk or visa-versa.

It should also be understood that as an alternative the finial and nipple may be of unitary construction and adapted to be threaded into the bottom of the switch housing to adjust the tension.

It thus is seen that a light assembly leveler is now provided which overcomes problems with light assemblies of the prior art. While this invention has been described in detail with particular references to the preferred embodiments thereof, it should be understood that many modifications, additions and deletions, in addition to those expressly recited, may be made thereto without departure from the spirit and scope of the invention as set forth in the following claims.

The invention claimed is:

1. A light assembly with leveler comprising:

a first mounting member having a concave bearing surface;

a mounting rod extending from said first mounting member;

a second mounting member having a convex bearing surface and a concave lower bearing surface opposite said convex bearing surface, said convex bearing surface configured to mate with said first mounting member concave bearing surface and having an opening therethrough;

a fastener coupled to said mounting rod, said fastener having a convex bearing surface configured to mate with said second mounting member concave bearing surface, and a light diffusor coupled to said second mounting member, whereby the second mounting member is movable relative to the first mounting member.

2. The light assembly with leveler of claim 1 wherein said second mounting member is comprised of a top mounting plate mounted to a top side of said diffusor and a cap mounted to a bottom side of said diffusor.

3. The light assembly with leveler of claim 1 wherein said second mounting member is of unitary construction.

4. The light assembly with leveler of claim 1 wherein said fastener is a finial.

5. The light assembly with leveler of claim 1 wherein said first mounting member is adapted to be mounted to a ceiling fan switch housing.

6. The light assembly with leveler of claim 5 wherein said fastener has a passage therethrough, and wherein a pull chain associated with said ceiling fan switch housing extends through said mounting rod and fastener.

7. The light assembly and leveler of claim 1 wherein said diffusor is a translucent bowl.

8. The light assembly and leveler of claim 1 wherein said diffusor is a multi-armed diffusor.

9. The light assembly and leveler of claim 1 wherein said first mounting member has a stop flange positioned about said mounting rod and wherein said second mounting member has a flange adapted to abut said first mounting member stop flange, whereby the abutment of the stop flange with the second mounting member flange limits the relative movement between the first and second mounting members.

10. A leveler adapted to be used in conjunction with a light assembly comprising:

a first mounting member having a concave bearing surface;

a mounting rod coupled with said first mounting member;

a second mounting member having a convex bearing surface configured to mate with said first mounting member concave bearing surface, and a concave lower bearing surface opposite said convex bearing surface; a light diffuser coupled to said second mounting member and a stop coupled to said mounting rod, said stop having a convex bearing surface configured to mate with said second mounting-member concave bearing surface, whereby the second mounting member is movable relative to the first mounting member and the stop.

11. The leveler of claim 10 wherein said second mounting member is comprised of a top mounting plate mounted to a top side of said diffusor and a cap mounted to a bottom side of said diffusor.

12. The leveler of claim 10 wherein said second mounting member is of unitary construction.

13. The leveler of claim 10 wherein said stop is a finial.

14. The leveler of claim 10 wherein said first mounting member is adapted to be mounted to a ceiling fan switch housing.

15. The leveler of claim 14 wherein said stop has a passage therethrough, and wherein a pull chain associated with said ceiling fan switch housing extends through said mounting rod and stop.

16. The leveler of claim 10 wherein said first mounting member has a stop flange positioned about said mounting rod and wherein said second mounting member has a flange adapted to abut said first mounting member stop flange, whereby the abutment of the stop flange with the second mounting member flange limits the relative movement between the first and second mounting members.

* * * * *